US011230890B2

(12) United States Patent
Naganawa et al.

(10) Patent No.: US 11,230,890 B2
(45) Date of Patent: Jan. 25, 2022

(54) WELL DRILLING BIT AND WELL DRILLING METHOD USING THE SAME

(71) Applicants: THE UNIVERSITY OF TOKYO, Tokyo (JP); TOHOKU UNIVERSITY, Sendai (JP); INPEX DRILLING CO., LTD., Tokyo (JP)

(72) Inventors: Shigemi Naganawa, Tokyo (JP); Noriyoshi Tuchiya, Miyagi (JP); Kuniaki Shimada, Tokyo (JP)

(73) Assignees: THE UNIVERSITY OF TOKYO, Tokyo (JP); TOHOKU UNIVERSITY, Miyagi (JP); INPEX DRILLING CO., LTD., Tokyo (JP)

( * ) Notice: Subject to any disclaimer, the term of this patent is extended or adjusted under 35 U.S.C. 154(b) by 11 days.

(21) Appl. No.: 16/480,631

(22) PCT Filed: Dec. 12, 2017

(86) PCT No.: PCT/JP2017/044523
§ 371 (c)(1),
(2) Date: Jul. 24, 2019

(87) PCT Pub. No.: WO2018/139082
PCT Pub. Date: Aug. 2, 2018

(65) Prior Publication Data

US 2019/0383102 A1 Dec. 19, 2019

(30) Foreign Application Priority Data

Jan. 26, 2017 (JP) ..... JP2017-012284

(51) Int. Cl.
*E21B 10/60* (2006.01)
*E21B 7/00* (2006.01)
(Continued)

(52) U.S. Cl.
CPC ..... *E21B 10/602* (2013.01); *E21B 7/00* (2013.01); *E21B 10/08* (2013.01); *E21B 10/42* (2013.01); *E21B 10/61* (2013.01); *E21B 10/54* (2013.01)

(58) Field of Classification Search
CPC ..... E21B 7/00; E21B 10/60; E21B 10/602; E21B 10/61; E21B 10/42; E21B 10/54; E21B 10/08
See application file for complete search history.

(56) References Cited

U.S. PATENT DOCUMENTS 2,548,463 A 4/1951 Blood
3,743,035 A * 7/1973 Tiraspolsky ..... E21B 7/00 175/317

(Continued)

FOREIGN PATENT DOCUMENTS

JP 55108592 A 8/1980
JP 2011508125 A 3/2011
JP 2014177810 A 9/2014

OTHER PUBLICATIONS

International Search Report (ISR) dated Mar. 6, 2018 (and English translation thereof) issued in International Application No. PCT/JP2017/044523.

(Continued)

*Primary Examiner* — Nicole Coy
(74) *Attorney, Agent, or Firm* — Holtz, Holtz & Volek PC

(57) ABSTRACT

A well drilling bit for drilling bedrocks includes a columnar bit body, and a drilling fluid flow path formed in the bit body to wash away drilled cuttings from a bottomhole and/or a periphery of the bit body. The flow path is provided with a venturi mechanism including a venturi tube having a reduced-diameter portion where a cross sectional area is reduced and capable of generating a decompression region (Continued)

around a tip of the bit body, the decompression region being more decompressed than a surrounding by the Venturi effect.

16 Claims, 7 Drawing Sheets

(51) Int. Cl.

| | |
|---|---|
| ***E21B 10/42*** | (2006.01) |
| ***E21B 10/61*** | (2006.01) |
| ***E21B 10/08*** | (2006.01) |
| *E21B 10/54* | (2006.01) |

(56) References Cited

U.S. PATENT DOCUMENTS

| | | | | | |
|---|---|---|---|---|---|
| 4,244,431 | A | | 1/1981 | Johnson | |
| 4,245,708 | A | * | 1/1981 | Cholet | E21B 10/18 175/325.2 |
| 4,303,137 | A | | 12/1981 | Fischer | |
| 5,355,967 | A | * | 10/1994 | Mueller | E21B 21/002 175/65 |
| 5,494,124 | A | * | 2/1996 | Dove | B05B 1/02 175/424 |
| 5,542,486 | A | * | 8/1996 | Curlett | E21B 7/18 175/393 |
| 5,632,349 | A | * | 5/1997 | Dove | B05B 1/02 175/393 |
| 5,653,298 | A | * | 8/1997 | Dove | B05B 1/02 175/424 |
| 5,775,443 | A | * | 7/1998 | Lott | E21B 10/18 175/340 |
| 7,775,299 | B2 | | 8/2010 | Khan et al. | |
| 8,607,897 | B2 | * | 12/2013 | Kolle | E21B 21/16 175/107 |
| 8,770,317 | B2 | * | 7/2014 | Kolle | E21B 4/02 175/71 |
| 9,869,134 | B2 | | 1/2018 | Nakamura et al. | |
| 2009/0279966 | A1 | | 11/2009 | Blair | |

OTHER PUBLICATIONS

Written Opinion dated Mar. 6, 2018 issued in International Application No. PCT/JP2017/044523.

* cited by examiner

WELL DRILLING BIT AND WELL DRILLING METHOD USING THE SAME

TECHNICAL FIELD

The present invention relates to a well drilling bit that can be used for drilling of wells, such as hydrocarbon wells of petroleum and natural gas, and relates to a well drilling method using the same. More specifically, the present invention relates to a well drilling bit capable of efficiently drilling high-temperature and hard geological formations and a well drilling method using the same.

BACKGROUND ART

Conventionally known as well drilling bits are roller cone bits (including tricone bits, see FIG. 8), PDC bits (polycrystalline diamond compact bits), and the like. Each of these drilling bits is configured to drill wells by cutting and fracturing rocks with hard cutters.

Among these, the roller cone bits can drill hard rocks (bedrocks) although their drilling speeds are slow. However, the roller cone bit essentially requires a bearing seal member made of a rubber elastic body or the like for bearing seal. The bearing seal member is limited in heat resistance, which raises a problem that the bearing seal member is unsuitable for drilling high-temperature geological formations.

On the other hand, the PDC bits can be used to drill high temperature geological formations because they are configured not to require any bearing seal member made of a rubber elastic body or the like. However, the PDC bit has a mechanism for drilling bedrocks depending on the hardness of polycrystalline diamond. Therefore, the PDC bit wears out hard when used for drilling hard rocks (bedrock formations), which raises a problem that frequent replacement of expensive PDC bits and the like is required and accordingly it is uneconomical and unsuitable.

For this reason, a well drilling bit capable of efficiently drilling wells even at high temperatures not suitable for the roller cone bits and even in hard geological formations not suitable for the PDC bits and a well drilling method using the same are desired earnestly.

Further, Patent Literature 1 discloses a programmable pressure drilling method including a step of letting fluid flow from a geological formation by adjusting the pressure to be substantially equal to or slightly lower than the pore pressure on the well, and a step of performing adjustment by pumping the flow of fluid from a bottomhole assembly or choking the flow of fluid into the bottomhole assembly between a programmable pressure zone and a well annulus portion or an annular zone, while drilling, thereby preventing an excessive pressure from being applied to the programmable pressure zone if controlling the well is unnecessary (see Patent Literature 1, specifically in claim 1 of CLAIMS, paragraphs [0030] to [0038] of the specification, and FIGS. 1 and 2 of the drawings).

However, the programmable pressure drilling method described in Patent Literature 1 intends to create a controllable pressure zone adjacent to a drilling bit and the bottomhole assembly by sealing close to the bottomhole assembly in order to safely drill an underbalanced exploration well. For this reason, it can be said that the invention described in Patent Literature 1 does not intend to control the pressure for efficiently drilling high-temperature and hard geological formations and therefore the above-mentioned problem is not recognized.

Patent Literature 2 discloses, as means for improving the efficiency in drilling hard geological formations, a drilling mechanism designed to alternately repeat heating and cooling in geological formations so as to form cracks or fractures in the hard geological formations. However, the drilling mechanism described in Patent Literature 2 requires the usage of expensive and special drilling pipes for introducing acetylene and oxygen to a bottomhole by the quantity corresponding to the drilling depth, and requires an additional mechanism for preventing mine fires from oxygen acetylene flames. Therefore, the overall energy efficiency is poor and it is difficult to reduce the drilling costs.

CITATION LIST

Patent Literature

Patent Literature 1: National Publication of International Patent Application No. 2911-508125

Patent Literature 2: U.S. Pat. No. 2,548,463

SUMMARY OF INVENTION

Technical Problem

Therefore, the present invention has been made in view of the above-mentioned problem and intends to provide a well drilling bit capable of efficiently drilling high-temperature and hard bedrock formations with lower replacement frequency at low costs and a well drilling method using the same.

Solution to Problem

A well drilling bit described in claim 1 is a well drilling bit for drilling bedrocks, including a columnar bit body and a drilling fluid flow path formed in the bit body to wash away drilled cuttings from a bottomhole and/or a periphery of the bit body. The flow path is provided with a venturi mechanism including a venturi tube having a reduced-diameter portion where the cross sectional area is reduced and capable of generating a decompression region around a tip of the bit body. The decompression region is more decompressed than a surrounding by the Venturi effect.

A well drilling bit described in claim 2 is the well drilling bit according to claim 1, wherein the flow path includes a first flow path communicating the venturi tube with an outer surface of the bit body near the tip thereof, a second flow path communicating the venturi tube with an outer surface of the bit body except for the tip thereof, and a third flow path communicating the outer surface of the bit body near the tip thereof with the second flow path, the first flow path and the second flow path are configured to be switchable so that the other is closed when one is opened, and the venturi mechanism generates the decompression flow area by sucking the drilling fluid into the third flow path at a flow speed of the drilling fluid flowing in the second flow path when the second flow path is opened.

A well drilling bit described in claim 3 is the well drilling bit according to claim 2, wherein switching of the flow path between the first flow path and the second flow path is performed by opening and closing of a slide port.

A well drilling bit described in claim 4 is the well drilling bit according to claim 2, wherein switching of the flow path between the first flow path and the second flow path is performed by a drop ball constituted by a spherical body that selectively closes the first flow path.

A well drilling bit described in claim 5 is the well drilling bit according to any one of claims 1 to 4, wherein the drilling bit is a PDC bit including PDC cutters made of a diamond sintered compact chip fixed to the outer surface of the bit body.

A well drilling method described in claim 6 is a well drilling method for drilling a well in high-temperature and hard bedrocks with the well drilling bit according to any one of claims 1 to 5, including generating the decompression region around the tip of the bit body to decompress and boil the drilling fluid, rapidly cooling the bedrocks by latent heat of vaporization when the drilling fluid is vaporized, and generating cracks in the bedrocks by thermal stress difference between the rapidly cooled portion and other portions and performing drilling.

A well drilling method described in claim 7 is a well drilling method for drilling a well in high-temperature and hard bedrocks with the well drilling bit according to any one of claims 2 to 5, including alternately repeating a drilling mode for opening the first flow path to let the drilling fluid flow in the first flow path and a decompression mode for opening the second flow path to let the drilling fluid flow in the second flow path, generating the decompression region around the tip of the bit body in the decompression mode to decompress and boil the drilling fluid, rapidly cooling the bedrocks by latent heat of vaporization when the drilling fluid is vaporized, and generating cracks in the bedrocks by thermal stress difference between the rapidly cooled portion and other portions, and then performing drilling in the drilling mode. Advantageous Effects of Invention The present invention as set forth in claims 1 to 7 can locally decompress and boil d (drilling fluid) in the vicinity of a bottomhole with the venturi mechanism, and can rapidly cool the surface of bedrocks by the latent heat of vaporization during the vaporization, thereby generating cracks in the bedrocks by the thermal stress difference between the rapidly cooled portion and other portions. For this reason, strength embrittlement of hard bedrocks can be induced, and high-temperature and hard bedrock formations can be efficiently drilled. Accordingly, it is possible to reduce the replacement frequency of the well drilling bit and reduce well drilling costs.

In particular, according to the present invention as set forth in claim 2, the switching between the first flow path and the second flow path can surely generate the decompression flow area in the vicinity of the bottomhole. Further, since the high-temperature and hard bedrock formations can be efficiently drilled by generating the decompression flow area with only the switching of one flow system of drilling fluid used for conventional well drilling, extremely high effect can be attained in reduction of the well drilling costs.

In particular, according to the present invention as set forth in claim 3 or 4, the switching of the flow path can be surely performed by the slide port or the drop ball, the switching operation time can be shortened.

In particular, according to the present invention as set forth in claim 5, it is unnecessary to prepare a bearing seal member made of a rubber elastic body or the like for bearing seal, unlike the roller cone bit. Therefore, the operation for drilling high-temperature geological formations can be efficiently performed at low costs.

In particular, according to the present invention as set forth in claim 6, the strength embrittlement of hard bedrocks can be induced using the thermal stress (thermal shock), and the high-temperature and hard bedrock formations can be efficiently drilled. Accordingly, it is possible to reduce the replacement frequency of the well drilling bit and reduce the well drilling costs.

In particular, according to the present invention as set forth in claim 7, by alternately repeating the drilling mode and the decompression mode, it is possible to induce the strength embrittlement of hard bedrocks using the thermal stress (thermal shock), and the high-temperature and hard bedrock formations can be efficiently drilled. Accordingly, it is possible to reduce the replacement frequency of the well drilling bit and reduce the well drilling costs.

DESCRIPTION OF EMBODIMENTS

Hereinafter, embodiments for implementing a well drilling bit according to the present invention and a well drilling method using the same will be described in detail below with reference to drawings.

First, a well drilling bit according to a first embodiment of the present invention will be described with reference to FIGS. 1 and 2. In an exemplary case described below, a PDC bit to which the present invention is applied includes PDC cutters each being made of a diamond sintered compact chip fixed to an outer surface of a bit body.

Figure 1:
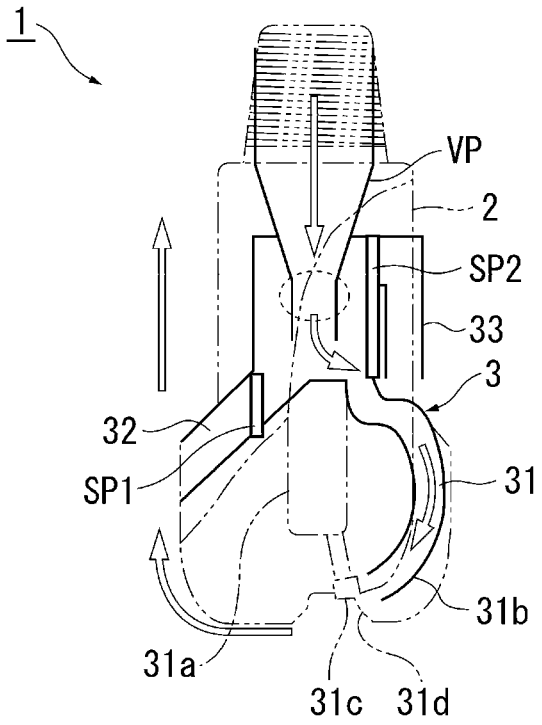
FIG. 1 is a vertical cross-sectional view schematically illustrating a drilling mode of a well drilling bit according to a first embodiment of the present invention.

FIG. 1 is a cross-sectional view schematically illustrating the configuration of the well drilling bit according to the first embodiment of the present invention, which is in a state of drilling mode. Further, FIG. 2 illustrates the well drilling bit in a state of decompression mode.

A well drilling bit 1 according to the present embodiments similar to the conventional PDC bit in main configuration but is different in that a plurality of flow paths is provided in addition to an ordinary flow path for letting drilling fluid flow and these are switchable.

Figure 2:
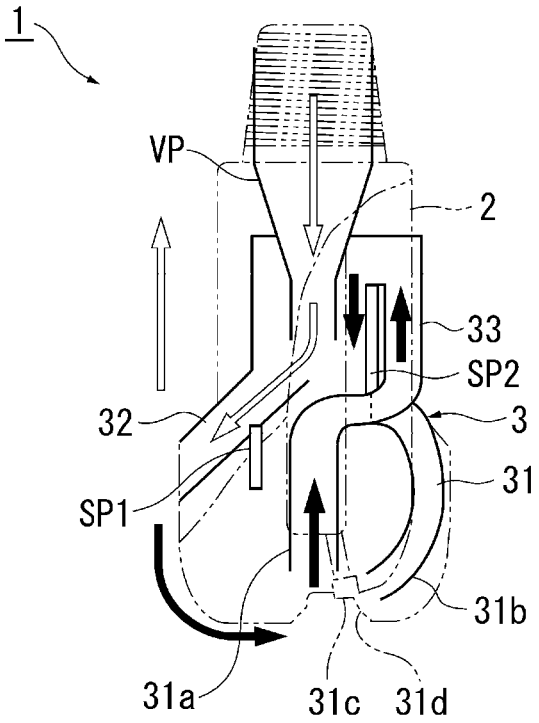
FIG. 2 is a vertical cross-sectional view schematically illustrating a decompression mode of the above-mentioned well drilling bit.

As illustrated in FIGS. 1 and 2, the well drilling bit 1 is mainly configured by a cylindrical bit body 2 that is a base member constituting the bit. A flow path 3 for letting drilling fluid flow s formed in the bit body 2.

Here, the drilling fluid has a function of washing away and discharging drilled cuttings (rock debris) of bedrocks cut down by the well drilling bit 1. In general, drilling mud is usable as the drilling fluid. The drilling mud, which is for well wall protection and viscosity and specific gravity adjustment, is a mixture of bentonite mainly composed of a montmorillonite clay mineral, which is a swelling material, and water. Of course, it is needless to say that water may be used alone as the drilling fluid or other additives may be added appropriately according to the type of wells to be drilled and the geological formation to be drilled.

(Bit Body)

The bit body 2 is substantially similar to the conventional PDC bit and is provided with a plurality of PDC cutters, each being made of a diamond sintered compact chip, fixed to the outer surface near the lower end to be brought into contact with bedrocks of a bottomhole to be drilled (although not illustrated). The bit body 2 is rotationally driven by a mud motor that rotates a shaft using the flow of drilling fluid, and has a function of drilling wells while scraping and fracturing rocks with hard blade edges of the PDC cutters.

(Flow Path)

The flow path 3 is connected to a pump (not illustrated) such as a mud pump (mud water pump) installed on the ground or the sea, and serves as a flow path for letting drilling fluid flow. The flow path 3 is provided with a venturi tube VP having a reduced-diameter portion (see an ellipse indicated by a broken line in FIG. 1) where the cross sectional area is reduced, which serves as a choke section described below, at a position corresponding to an upper part f the bit body 2.

At the tip (the lower side) of the venturi tube VP, the flow path 3 is divided mainly into three flow paths of a first flow path 31, a second flow path 32, and a third flow path 33, or the like. The first flow path 31 is configured by a center flow path 31*a* extending straight directly from the tip of the venturi tube VP, a plurality of bit nozzle flow paths 31*b* detouring around the center flow path 31*a* in the lateral direction, and the like. The first flow path 31 is a flow path that is also present in the conventional PDC bit.

The center flow path 31*a* is a flow path extending from the tip of the venturi tube VP and communicating with a center nozzle 31*c* provided on a lower end surface of the bit body 2 near the center of the tip thereof. The bit nozzle flow path 31*b* is a flow path that communicates the center flow path 31*a* with a bit nozzle 31*d* provided on the tip surface of the bit body 2.

The bit nozzle 31*d* is a discharge port, which is provided on the outer surface of the tip of the bit body 2 positioned on a substantially equally spaced radius centering on the axial center of the bit body 2 and has a function of vigorously discharging drilling fluid and washing away drilled cuttings adhering to the PDC cutters.

The second flow path 32 is a flow path that communicates the venturi tube VP with a side circumferential outer surface of the cylindrical bit body 2. The second flow path 32 is a flow path connected to a diameter-reduced conduit of the venturi tube VP and having a cross sectional area narrowed to 1/36 or less of the center flow path 31*a*, and communicates with the third flow path 33 in the vicinity of the venturi tube VP. It is not always necessary that the end of the second flow path 32 is provided on the side circumferential outer surface of the bit body 2 if the position where it communicates with the outer surface of the bit body 2 is other than the vicinity of the tip of the bit body 2.

The third flow path 33 is a decompression flow path for reducing the pressure in the vicinity of the bottomhole, and communicates the second flow path 32 with a central vicinity of the tip of the bit body 2. In the present embodiment, the third flow path 33 communicates the vicinity of the venturi tube VP of the second flow path 32 with the center flow path 31*a* of the first flow path 31.

The second flow path 32 is provided with a slide port SP1 that is an openable valve. The third flow path 33 is provided with a slide port SP2 that is an openable three-way valve. These slide ports SP1 and SP2 are configured to slide and move in conjunction with each other to simultaneously open or close the second flow path 32 and the third flow path 33.

Therefore, as illustrated in FIG. 1, in the drilling mode in which the second flow path 32 and the third flow path 33 are closed by the slide ports SP1 and SP2 and the first flow path 31 is opened to let the drilling fluid flow in the first flow path 31, the drilling fluid flows in the direction of arrows.

The flow of drilling fluid in the drilling mode indicated by the arrows is the same flow as the conventional PDC bit. In this drilling mode, while the well drilling bit 1 is rotating to drill in the bottomhole, the drilling fluid flows in the direction indicated by arrows, thereby pushing upward and discharge drilled cuttings (rock debris) together with the drilling fluid. The drilling fluid ascends along with the drilled cuttings (rock debris) and returns to the ground. Then, the rock debris are removed by a large sieving shaker or a centrifugal type or cyclone type solid-liquid separator. After viscosity and specific gravity adjustment or the like, the drilling fluid is circulated again into the well.

As illustrated in FIG. 2, in the decompression mode in which the second flow path 32 and the third flow path 33 are opened by sliding and moving the slide ports SP1 and SP2 to let the drilling fluid flow in the second flow path 32, the drilling fluid flows in the direction of arrows.

At this moment, in the third flow path 33 communicating with the second flow path 32 whose cross sectional area is narrowed to 1/36 or less of the center flow path 31*a*, a pressure difference with the surroundings is generated due to the Venturi effect described below and the drilling fluid is sucked in the direction indicated by black arrows. As a result, the drilling fluid in the vicinity of the bottomhole is rapidly decompressed and the drilling fluid in a high-temperature and high-pressure state locally causes decompression boiling. Therefore, the surface of bedrocks can be rapidly cooled by the latent heat of vaporization during the vaporization, and cracks can be generated in the bedrocks by the thermal stress difference between the rapidly cooled portion and other portions.

(Venturi Mechanism)

Figure 3:
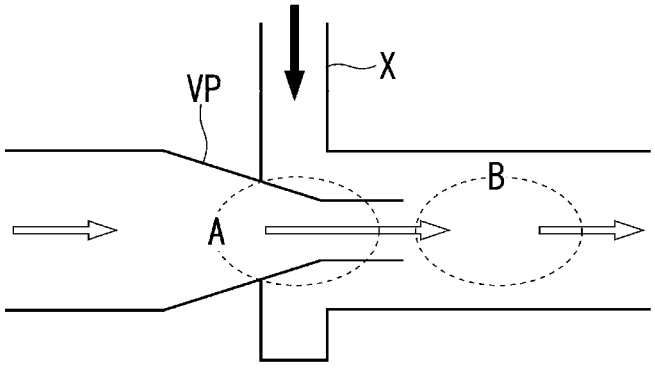
FIG. 3 is an explanatory view illustrating the principle of a venturi mechanism.

Next, the principle of Venturi will be simply described with reference to FIG. 3. FIG. 3 is an explanatory view illustrating the principle of Venturi. As illustrated in FIG. 3, when a flow path of fluid is provided with the venturi tube VP including the reduced-diameter portion serving as a choke section A where the cross sectional area is reduced, the flow speed increases at the choke section A due to the Venturi effect as indicated by the magnitude of the arrow.

Further, as the flow speed increases, the pressure becomes relatively lower according to Bernoulli's theorem. As a result, a pressure drop occurs in a flow area B. If there is another flow path X communicating with this flow area B, a phenomenon of fluid sucking is induced as indicated by a black arrow. Accordingly, the principle of the present invention is to communicate the flow path X with the tip surface of the bit body 2 in the vicinity of the bottomhole, thereby decompressing the vicinity of the bottomhole, boiling the drilling fluid, and rapidly cooling bedrocks.

The pressure drop due to the Venturi effect can be obtained from the following formula (numerical expression 1). Assuming that inner diameter d1 of the flow path 3 inside the bit body 2 described above is 100 m flow rate Q of the drilling fluid is 2,000 L/min, specific gravity p of the drilling fluid is 1.05 SG, and flow path cross section ratio (A2/A1) is narrowed to 1/36 or less by a venturi mechanism as described above, the calculation using the following formula (numerical expression 1) reveals that a pressure drop of approximately 13 MPa may occur. From the value of this pressure drop, it is considered that optimizing the flow path design in the future will realize a decompression exceeding 20 MPa.

[Numerical Expression 1]

$$Q = C\frac{A_2}{\sqrt{1-\left(\frac{A_2}{A_1}\right)^2}}\sqrt{\frac{2\Delta p}{\rho}}$$

$$\therefore \Delta p = \frac{\rho Q^2}{2C^2A_2^2}\left[1-\left(\frac{A_2}{A_1}\right)^2\right] = \frac{8\rho Q^2}{\pi^2C^2d_2^4}\left[1-\left(\frac{d_2}{d_1}\right)^4\right]$$

Figure 4:
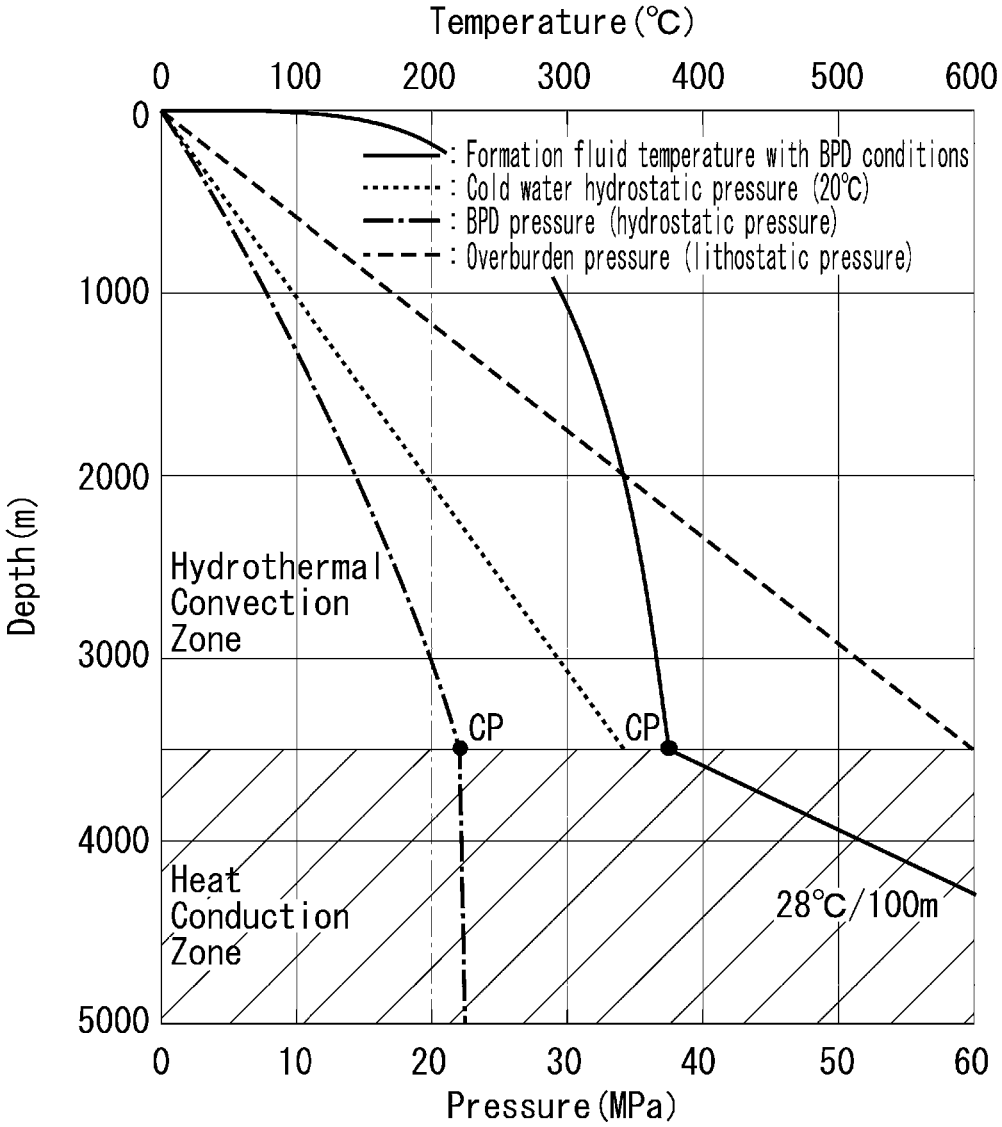
FIG. 4 is a graph illustrating temperature and pressure conditions of a geological formation assumed in supercritical geothermal development.

FIG. 4 is a graph illustrating temperature and pressure conditions of a geological formation assumed in supercritical geothermal development. A bold solid line indicates formation fluid temperature with BPD conditions, a dotted line indicates cold water hydrostatic pressure (20° C.) an alternate long and short dash line indicates BPD pressure (hydrostatic pressure), and a broken line indicates overburden pressure (lithostatic pressure).

As illustrated in FIG. 4, the geological formation of a supercritical geothermal field to be drilled by the well drilling bit 1 according to the present embodiment is a geological formation whose depth is 3500 m or more (although the depth may vary somewhat depending on conditions of the geological formation), such as a heat conduction zone indicated by a hatched region, under the conditions illustrated in FIG. 4. In short, the geological formation to be drilled in the supercritical geothermal development is a geological formation in the heat conduction zone beyond a hydrothermal convection zone, that is a geological formation in which the formation water is in a supercritical state, exceeding the critical point (temperature 374° C., pressure 22.1 MPa) of water. In such a geological formation, the geothermal gradient is very high, and the formation temperature with respect to the depth can be assumed to be expressed by the bold solid line indicated in the drawing. The alternate long and short dash line in the drawing indicates assumed formation pressure in this distribution of the formation temperature. When entering into a region where the formation water becomes supercritical, although the fractured form of rocks is brittle at shallower depths, it becomes a region where ductile fracturing occurs and the drilling becomes difficult.

Figure 5:
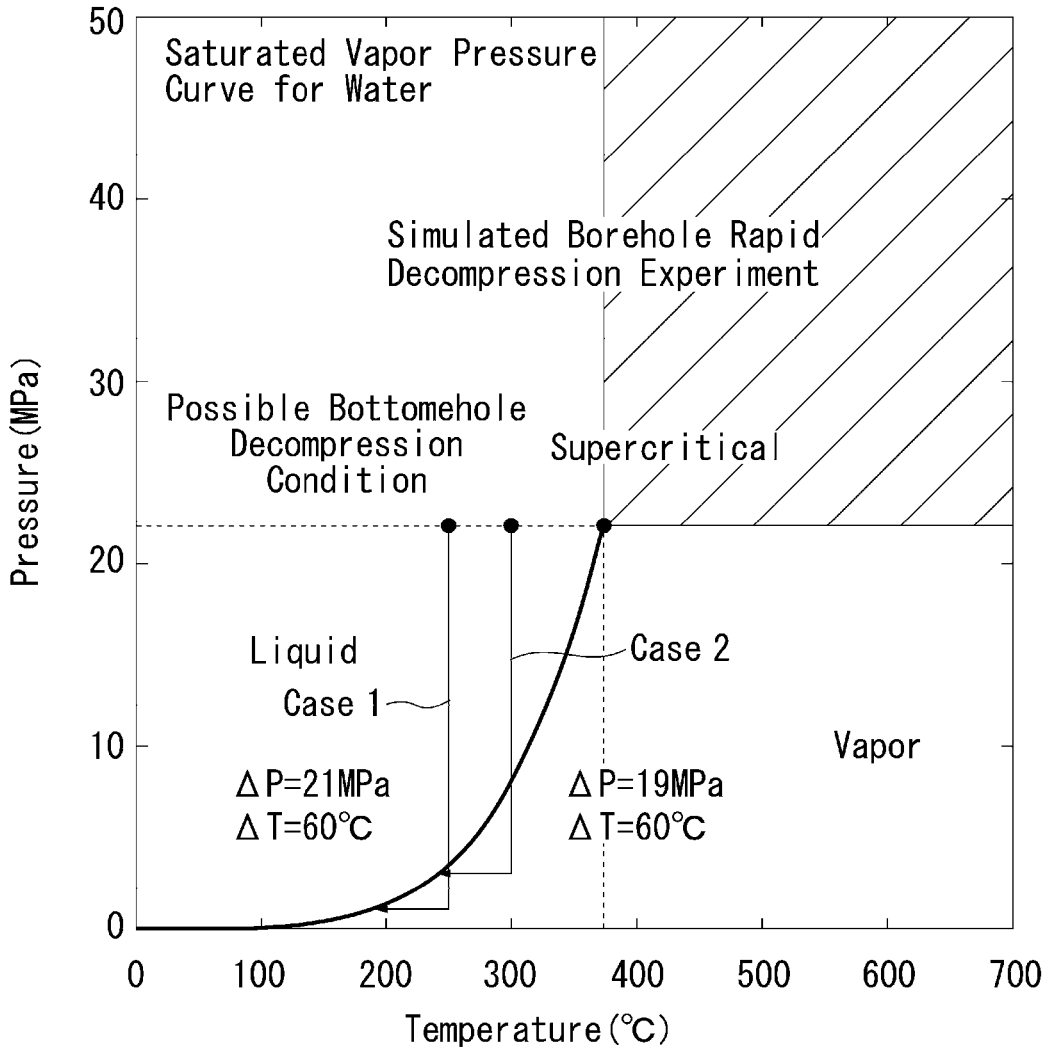
FIG. 5 is a pressure-temperature phase diagram illustrating the degree of cooling accompanying rapid decompression of a bottomhole.

FIG. 5 is a pressure-temperature phase diagram illustrating the degree of cooling accompanying rapid decompression of a bottomhole. This diagram is a phase diagram representing the pressure-temperature relationship of water, in which a bold solid line indicates the boiling curve of water (saturated vapor pressure curve for water). At pressures higher than this curve (upper left), water is liquid. At pressures lower than this curve, water is gas (vapor). A black dot at the end point of the boiling curve indicates a supercritical point of water, and a hatched region indicates the supercritical state.

Accordingly, as indicated by Case 1 in FIG. 5, when assuming that the bottomhole temperature during drilling is approximately 250° C. and the bottomhole pressure is approximately 22.5 Mpa, the bottomhole pressure becomes 1.5 MPa if the pressure can be reduced by 21 MPa. In this case, the drilling fluid will boil because the bottomhole pressure crosses the boiling curve in the drawing. At this moment, the drilling fluid is deprived of its latent heat of vaporization and reaches equilibrium at the temperature-pressure indicated by the arrow of Case 1. The temperature drop at this moment is approximately 60° C. according to the drawing. Further, as indicated by Case 2 in FIG. 5, when the assumed temperature is higher than that in Case 1, it is understood that rapid cooling of approximately 60° C. can be similarly realized at a smaller pressure of 19 MPa.

The above-described well drilling bit 1 according to the first embodiment of the present invention can locally decompress and boil the drilling mud (drilling fluid) in the vicinity of the bottomhole with the venturi mechanism, and can rapidly cool the surface of bedrocks by the latent heat of vaporization during the vaporization, thereby generating cracks in the bedrocks by the thermal stress difference between the rapidly cooled portion and other portions. For this reason, strength embrittlement of hard bedrocks can be induced, and high-temperature and hard bedrock formations can be efficiently drilled. Accordingly, it is possible to reduce the replacement frequency of the well drilling bit and reduce the well drilling costs.

Second Embodiment

Figure 6:
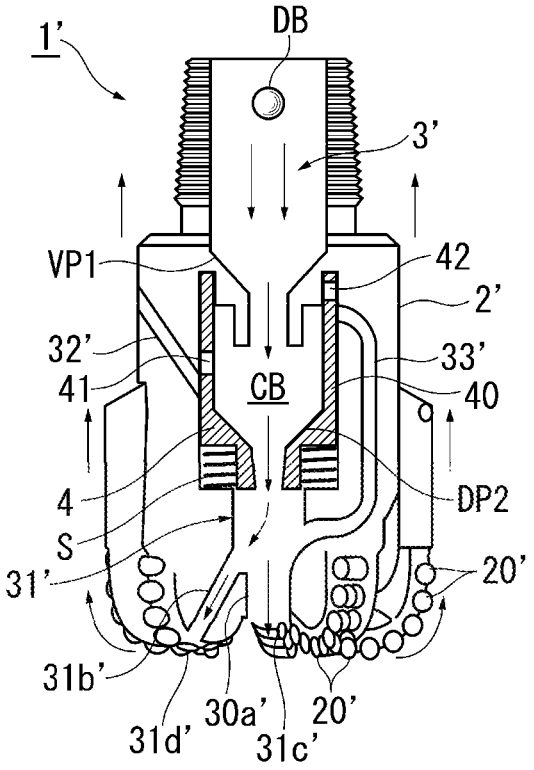
FIG. 6 is a vertical cross-sectional view schematically illustrating a drilling mode of a well drilling bit according to a second embodiment of the present invention.
Figure 7:
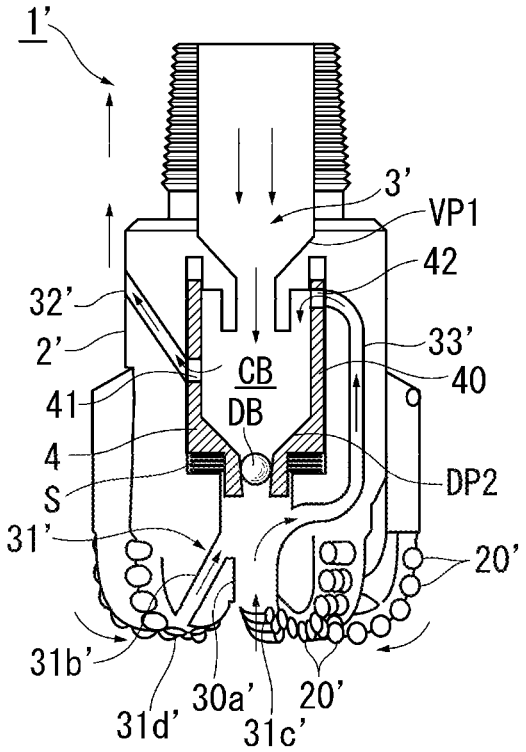
FIG. 7 is a vertical cross-sectional view schematically illustrating a decompression mode of the above-mentioned well drilling bit.

Next, a well drilling bit 1' according to a second embodiment of the present invention will be described with reference to FIGS. 6 and 7. FIG. 6 is a vertical cross-sectional view schematically illustrating a drilling mode of the well drilling bit 1' according to the second embodiment of the present invention. FIG. 7 is a vertical cross-sectional view schematically illustrating a decompression mode of the well drilling bit 1'.

Similar to the well drilling bit 1 according to the twelfth embodiment, the well drilling bit 1' according to the second embodiment of the present invention is mainly configured by a cylindrical bit body 2' that is a base member of the bit. A flow path 3' for letting drilling fluid flow s formed in the bit body 2'.

(Bit Body)

The bit body 2' is substantially similar to the conventional PDC bit and is provided with a plurality of PDC cutters 20', each being made of a diamond sintered compact chip, fixed to an outer surface thereof near the lower end to be brought into contact with bedrocks of a bottomhole to be drilled. The bit body 2' has a function of drilling a well while scraping and fracturing rocks with hard blade edges of the PDC cutters 20'.

(Flow Path)

The flow path 3' is connected to a pump (not illustrated) such as a mud pump installed on the ground or the sea, and serves as a flow path for letting drilling fluid flow. The flow path 3' is provided with a venturi tube VP1 having a reduced-diameter portion where the cross sectional area is reduced, which serves as a choke section described below, at a position corresponding to an upper part of the bit body 2'.

Similar to the above-mentioned flow path 3 of the well drilling bit 1, the flow path 3' is mainly configured by three flow paths of a first flow path 31', a second flow path 32', and a third flow path 33', or the like. The flow path 3' is different from the above-mentioned flow path 3 of the well drilling bit 1 in that branching from the tip of the venturi tube VP1 is intervened by a chamber CB in a piston 4 elastically supported by the bit body 2'.

The piston 4 has a cylindrical piston body 40 with a diameter-reduced tip serving as a drop-ball receiving portion DP2. The piston body 40 is elastically supported by a coil spring S (spiral spring) on the bit body 2' so as to be vertically slidable. The inside of the piston body 40 is configured as the chamber CB for temporarily storing drilling fluid. The piston body 40 is bored with a communication hole 41 for communicating with the second flow path 32' and a communication hole 42 for communicating with the third flow path 33', as described below.

The first flow path 31' is configured by a center flow path 31*a*' extending straight directly from the tip of the drop-ball receiving portion DP2 of the piston 4, a plurality of bit nozzle flow paths 31*b*' detouring around the center flow path 31*a*' in the lateral direction, and the like. The first flow path 31' is a flow path that is also present in the conventional PDC bit.

The center flow path 31*a*' is a flow path extending from the tip of the drop-ball receiving portion DP2 and communicating with a center nozzle 31*c*' provided on a lower outer surface of the bit body 2' at the center of the tip thereof. The bit nozzle flow path 31*b*' is a flow path that communicates the center flow path 31*a*' with a bit nozzle 31*d*' provided on the outer surface of the tip of the bit body 2'.

The bit nozzle 31*d*' is a discharge port, which is provided on the outer surface of the tip of the bit body 2 positioned on a substantially equally spaced radius centering on the axial center of the bit body 2 and has a function of vigorously discharging drilling fluid and washing away drilled cuttings adhering to the PDC cutters 20'.

The second flow path 32' is a flow path that communicates the chamber CB with a side circumferential outer surface of the cylindrical bit body 2. The second flow path 32' is a flow path having a cross sectional area narrowed to 1/36 or less of the inner diameter cross sectional area of the reduced-diameter portion of the venturi tube VP1. It is not always necessary that the end of the second flow path 32' is provided on the side circumferential outer surface of the bit body 2' if the position where it communicates with the outer surface of the bit body 2' is other than the vicinity of the tip of the bit body 2'.

The third flow path 33' is a decompression flow path for reducing the pressure in the vicinity of the bottomhole, and communicates the chamber CB with a central vicinity of the tip of the bit body 2'. In the present embodiment, the third flow path 33' communicates the chamber CB with the center flow path 31*a*' of the first flow path 31'.

The switching of the flow path of the well drilling bit 1' is performed by a drop ball DB that is constituted by a rubber elastic spherical body having a diameter larger than the inner diameter of the drop-ball receiving portion DP2 and smaller than the inner diameter of the venturi tube VP1. As illustrated in FIGS. 6 and 7, the drop ball DB closes the flow path by coming into contact with the drop ball DB drop-ball receiving portion DP2, thereby stopping the supply of drilling fluid to the first flow path 31'.

Further, as described above, since the piston 4 is elastically supported by the coil spring S so as to be vertically slidable, the piston 4 is configured to be pushed down when the drop ball DB comes into contact with the drop-ball receiving portion DP2.

When the piston 4 is pushed down, the communication hole 41 and the communication hole 42 bored in the cylindrical piston body 40 move downward correspondingly. At the lowered positions, the communication hole 41 communicates with the second flow path 32' and the communication hole 42 communicates with the third flow path 33'.

As described above, since the piston 4 is urged upward by the coil spring S, as illustrated in FIG. 6, the communication hole 41 and the communication hole 42 are positionally deviated from the second flow path 32' and the third flow path 33' without any communication, unless the drop ball DB closes and pushes down the drop-ball receiving portion DP2. Therefore, the second flow path 32' and the third flow path 33' are kept closed. Accordingly, in the drilling mode in which the first flow path 31' is opened to let the drilling fluid flow in the first flow path 31', the drilling fluid flows in the direction indicated by arrows.

The flow of drilling fluid in the drilling mode indicated by the arrows is the same flow as the conventional PDC bit. In this drilling mode, while the well drilling bit 1' is rotating to drill in the bottomhole, the drilling fluid flows in the direction indicated by the arrows, thereby discharging drilled cuttings (rock debris) together with the drilling fluid upward from the bottomhole via a well annulus portion. The drilling fluid ascends along with the drilled cuttings (rock debris) and returns to the ground (or on the sea). Then, rock debris are removed by a large sieving shaker or a centrifugal type or cyclone type solid-liquid separator. After viscosity and specific gravity adjustment or the like, the drilling fluid is circulated again into the well.

Next, as illustrated in FIG. 7, when the drop ball DB is thrown into a drilling pipe from the ground, the thrown drop ball DB is conveyed by the flow of drilling fluid and reaches the inside of the bit body 2'. At this time, since the outer diameter of the drop ball DB is smaller than the inner diameter of the venturi tube VP1, the drop ball DB passes through the venturi tube VP1. However, since the inner diameter of the drop-ball receiving portion DP2 positioned lower is larger than the diameter of the drop ball DB, the drop ball DB is latched by the drop-ball receiving portion DP2 and closes the flow path. When the drop-ball receiving portion DP2 is closed by the drop ball DB, the piston 4 is pushed down by the drop ball DB. Then, the communication hole 41 and the communication hole 42 bored in the piston body 40 move downward correspondingly and the chamber CB communicates with the second flow path 32' and the third flow path 33'. Accordingly, in the decompression mode in which the second flow path 32' and the third flow path 33' are opened to let drilling fluid flow in the second flow path 32, the drilling fluid flows in the direction of arrows.

As described above, the cross sectional area of the second flow path 32' is narrowed to 1/36 or less of the inner diameter of the reduced-diameter portion of the venturi tube VP1. For this reason, in the third flow path 33' communicating with the second flow path 32' via the chamber CB, a pressure difference with the surroundings is generated due to the Venturi effect and the drilling fluid is sucked in the direction indicated by arrows. As a result, the drilling fluid in the vicinity of the bottomhole is rapidly decompressed and the drilling fluid in a high-temperature and high-pressure state locally causes decompression boiling, as described above. Therefore, the surface of bedrocks can be rapidly cooled by the latent heat of vaporization during the vaporization, and cracks can be generated in the bedrocks by the thermal stress difference between the rapidly cooled portion and other portions.

When shifting from the decompression mode to the drilling mode, the pressure is further applied by the mud pump on the ground. The pressurization enables the drop ball DB made of the rubber elastic body to pass through the drop-ball receiving portion DP2 whose diameter is smaller. Of course, when shifting to the decompression mode again, the drop ball DB to be thrown into next may be another one.

In practice, in order to periodically perform the switching between the decompression mode and the drilling mode, drop balls DB are thrown into at certain intervals. The drop ball DB having passed through the drop-ball receiving portion DP2 is crashed by the well drilling bit 1'.

Although the well drilling bits according to the first and second embodiments of the present invention have been described in detail, the above-mentioned or illustrated embodiments are merely examples embodied for carrying out the present invention, and the technical scope of the present invention should not be interpreted in a limited manner by these.

Figure 8:
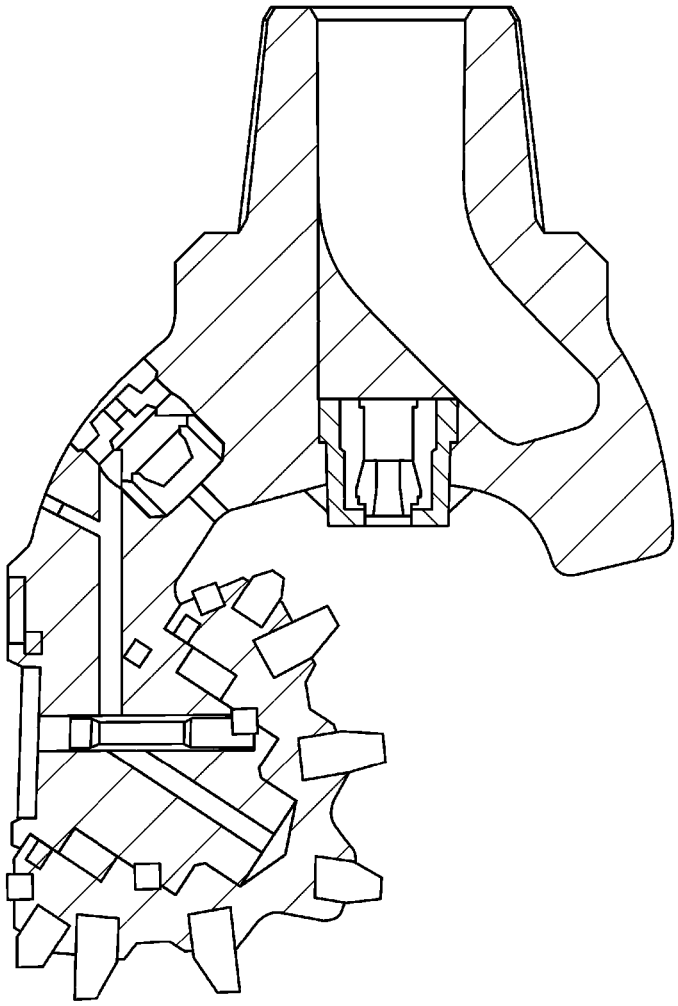
Fig. 8 PRIOR ART
FIG. 8 is a vertical cross-sectional view illustrating a conventional tricone bit.

In particular, although the PDC bit is exemplarily described as a bit to which the present invention is applied, the present invention can be applied to a roller cone bit such as the tricone bit, as illustrated in FIG. 8. In this case, as described above, the roller cone bit has a bearing seal member made of a rubber elastic body or the like and will encounter a problem that it cannot be used in high-temperature geological formations. However, if a heat-resistant bearing seal member is obtainable by any other method, it is apparent that the venturi mechanism can generate cracks in the bedrocks by the thermal stress difference, even when the present invention is applied to roller cone bits. In that case, hard geological formations can be drilled more efficiently.

Further, although the slide ports and the drop ball have been exemplarily described for the switching of the flow path, it is needless to say that they can be replaced by well-known switching means, such as a cylindrical cam mechanism, appropriately.

[Well Drilling Method]

Next, the well drilling method according to an embodiment of the present invention will be described with reference to FIGS. 1, 2, 6, and 7.

As illustrated in FIGS. 1 and 6, the well drilling method according to the present embodiment is similar to the conventional well drilling method in drilling the ground in the drilling mode as usual, before reaching the geological formation of the supercritical geothermal field, i.e., the heat conduction zone (see FIG. 4). At this time, as described above, the well drilling bit 1, 1' is rotated by the mud motor that rotates the shaft using the flow of drilling fluid so as to scrape and break the bedrocks with PDC cutters while drilling ahead.

The drilled cuttings (rock debris) resulting from scraping the bedrocks with the PDC cutters are washed away upward and discharged together with the drilling fluid from the bottomhole. The drilling fluid ascends along with the drilled cuttings and returns o the ground. Then, the rock debris or the like are removed by the large sieving shaker or the centrifugal type or cyclone type solid-liquid separator. After viscosity and specific gravity adjustment or the like, the drilling fluid is circulated again into the well.

Then, upon reaching the geological formation of the supercritical geothermal field, the switching to the decompression mode for letting the drilling fluid flow in the second flow path 32, 32' is performed as illustrated in FIGS. 2 and 7. Specifically, it can be determined that the geological formation of the supercritical geothermal field has been reached when the drilling speed is, for example, 1 m or less, or 0.5 m or less, per hour at the depth having been reached, and the switching to the decompression mode can be performed. Of course, it is needless to say that any other method such as measurement of temperature or pressure may be used in determining the reaching to the geological formation of the supercritical geothermal field.

In the decompression mode, as described above, the vicinity of the bottomhole is rapid decompressed by Venturi effect and the drilling fluid in the high-temperature and high-pressure state locally causes decompression boiling. Therefore, the surface of bedrocks can be rapidly cooled by the latent heat of vaporization during the vaporization, and cracks can be generated in the bedrocks by the thermal stress difference between the rapidly cooled portion and other portions.

The well drilling method according to the present embodiment alternately repeats the decompression mode and the drilling mode in a short time. The repetition in a short time can realize steep temperature changes in heating caused by rapid cooling of the surface of bedrocks by decompression and subsequent suspend, and it easily induces the strength embrittlement by the thermal stress difference occurring in the bedrocks.

In this case, alternately repeating the decompression mode and the drilling mode does not necessarily indicate alternately performing the decompression mode and the drilling mode only one time. That is, it intends to include repeating decompression/rapid cooling in the decompression mode→suspend→decompression/rapid cooling, in a short time, such as decompression mode→pause→decompression mode→drilling mode.

The well drilling method according to the present embodiment includes subsequently drilling the bedrocks in the drilling mode again. At this time, since the bedrocks subjected to the previous process are brittle, performing drilling without imparting a load on the PDC cutters of the well drilling bit 1, 1' becomes possible. Therefore, the well drilling method according to the present embodiment can efficiently drill high-temperature and hard bedrock formations, and can reduce the well drilling costs by reducing the replacement frequency of the well drilling bit 1, 1'.

REFERENCE SIGNS LIST

1, 1': well drilling bit
2, 2': bit body
20': PDC cutters
3, 3': flow path
31, 31': first flow path
31*a*, 31*a'*: center flow path
31*b*, 31*b'*: bit nozzle flow path
31*c*, 31*c'*: center nozzle
31*d*, 31*d'*: bit nozzle
32, 32': second flow path
33, 33': third flow path
SP1, SP2: slide port
CB: chamber
4: piston
40: piston body
41, 42: communication hole
S: coil spring
VP, VP1: venturi tube
DB: drop ball
DP: drop ball receiver
A: choke section

The invention claimed is:

1. A well drilling bit for drilling bedrocks, the well drilling bit comprising:

a columnar bit body; and a drilling fluid flow path formed in the bit body to wash away drilled cuttings from at least one of a bottomhole and a periphery of the bit body, wherein:

the flow path is provided with a venturi mechanism including a venturi tube having a reduced-diameter portion where a cross sectional area is reduced and configured to generate a decompression region around a tip of the bit body, the decompression region being more decompressed than a surrounding region by the Venturi effect, so as to locally cause decompression boiling of the drilling fluid in a vicinity of the bottom-hole, the flow path includes a first flow path communicating the venturi tube with an outer surface of the bit body near the tip thereof, a second flow path communicating the venturi tube with an outer surface of the bit body except for the tip thereof, and a third flow path communicating the outer surface of the bit body near the tip thereof with the second flow path, the first flow path and the second flow path are configured to be switchable so that the other is closed when one is opened, and the venturi mechanism generates a decompression flow area by sucking the drilling fluid into the third flow path at a flow speed of the drilling fluid flowing in the second flow path when the second flow path is opened.

2. The well drilling bit according to claim 1, wherein switching of the flow path between the first flow path and the second flow path is performed by opening and closing of a slide port.

3. The well drilling bit according to claim 2, wherein the drilling bit is a PDC bit including PDC cutters made of a diamond sintered compact chip fixed to the outer surface of the bit body.

4. A well drilling method for drilling a well in high-temperature and hard bedrocks with the well drilling bit according to claim 3, the well drilling method comprising:

generating the decompression region around the tip of the bit body to decompress and boil the drilling fluid;

rapidly cooling the bedrocks by latent heat of vaporization when the drilling fluid is vaporized; and generating cracks in the bedrocks by thermal stress difference between the rapidly cooled portion and other portions and performing drilling.

5. A well drilling method for drilling a well in high-temperature and hard bedrocks with the well drilling bit according to claim 2, the well drilling method comprising:

generating the decompression region around the tip of the bit body to decompress and boil the drilling fluid;

rapidly cooling the bedrocks by latent heat of vaporization when the drilling fluid is vaporized; and generating cracks in the bedrocks by thermal stress difference between the rapidly cooled portion and other portions and performing drilling.

6. A well drilling method for drilling a well in high-temperature and hard bedrocks with the well drilling bit according to claim 2, the well drilling method comprising:

alternately repeating a drilling mode for opening the first flow path to let the drilling fluid flow in the first flow path and a decompression mode for opening the second flow path to let the drilling fluid flow in the second flow path;

generating the decompression region around the tip of the bit body in the decompression mode to decompress and boil the drilling fluid;

rapidly cooling the bedrocks by latent heat of vaporization when the drilling fluid is vaporized; and generating cracks in the bedrocks by thermal stress difference between the rapidly cooled portion and other portions, and then performing drilling in the drilling mode.

7. The well drilling bit according to claim 1, wherein switching of the flow path between the first flow path and the second flow path is performed by a drop ball constituted by a spherical body that selectively closes the first flow path.

8. The well drilling bit according to claim 7, wherein the drilling bit is a PDC bit including PDC cutters made of a diamond sintered compact chip fixed to the outer surface of the bit body.

9. A well drilling method for drilling a well in high-temperature and hard bedrocks with the well drilling bit according to claim 8, the well drilling method comprising:

generating the decompression region around the tip of the bit body to decompress and boil the drilling fluid;

rapidly cooling the bedrocks by latent heat of vaporization when the drilling fluid is vaporized; and generating cracks in the bedrocks by thermal stress difference between the rapidly cooled portion and other portions and performing drilling.

10. A well drilling method for drilling a well in high-temperature and hard bedrocks with the well drilling bit according to claim 7, the well drilling method comprising:

generating the decompression region around the tip of the bit body to decompress and boil the drilling fluid;

rapidly cooling the bedrocks by latent heat of vaporization when the drilling fluid is vaporized; and generating cracks in the bedrocks by thermal stress difference between the rapidly cooled portion and other portions and performing drilling.

11. A well drilling method for drilling a well in high-temperature and hard bedrocks with the well drilling bit according to claim 7, the well drilling method comprising:

alternately repeating a drilling mode for opening the first flow path to let the drilling fluid flow in the first flow path and a decompression mode for opening the second flow path to let the drilling fluid flow in the second flow path;

generating the decompression region around the tip of the bit body in the decompression mode to decompress and boil the drilling fluid;

rapidly cooling the bedrocks by latent heat of vaporization when the drilling fluid is vaporized; and generating cracks in the bedrocks by thermal stress difference between the rapidly cooled portion and other portions, and then performing drilling in the drilling mode.

12. The well drilling bit according to claim 1, wherein the drilling bit is a PDC bit including PDC cutters made of a diamond sintered compact chip fixed to the outer surface of the bit body.

13. A well drilling method for drilling a well in high-temperature and hard bedrocks with the well drilling bit according to claim 12, the well drilling method comprising:

generating the decompression region around the tip of the bit body to decompress and boil the drilling fluid;

rapidly cooling the bedrocks by latent heat of vaporization when the drilling fluid is vaporized; and generating cracks in the bedrocks by thermal stress difference between the rapidly cooled portion and other portions and performing drilling.

14. A well drilling method for drilling a well in high-temperature and hard bedrocks with the well drilling bit according to claim 12, the well drilling method comprising:

alternately repeating a drilling mode for opening the first flow path to let the drilling fluid flow in the first flow path and a decompression mode for opening the second flow path to let the drilling fluid flow in the second flow path;

generating the decompression region around the tip of the bit body in the decompression mode to decompress and boil the drilling fluid;

rapidly cooling the bedrocks by latent heat of vaporization when the drilling fluid is vaporized; and generating cracks in the bedrocks by thermal stress difference between the rapidly cooled portion and other portions, and then performing drilling in the drilling mode.

15. A well drilling method for drilling a well in high-temperature and hard bedrocks with the well drilling bit according to claim 1, the well drilling method comprising:

generating the decompression region around the tip of the bit body to decompress and boil the drilling fluid;

rapidly cooling the bedrocks by latent heat of vaporization when the drilling fluid is vaporized; and generating cracks in the bedrocks by thermal stress difference between the rapidly cooled portion and other portions and performing drilling.

16. A well drilling method for drilling a well in high-temperature and hard bedrocks with the well drilling bit according to claim 1, the well drilling method comprising:

alternately repeating a drilling mode for opening the first flow path to let the drilling fluid flow in the first flow path and a decompression mode for opening the second flow path to let the drilling fluid flow in the second flow path;

generating the decompression region around the tip of the bit body in the decompression mode to decompress and boil the drilling fluid;

rapidly cooling the bedrocks by latent heat of vaporization when the drilling fluid is vaporized; and generating cracks in the bedrocks by thermal stress difference between the rapidly cooled portion and other portions, and then performing drilling in the drilling mode.

* * * * *